US005095316A

United States Patent [19]

Hakkaku

[11] Patent Number: 5,095,316

[45] Date of Patent: Mar. 10, 1992

[54] METHOD FOR RECORDING A MULTI-COLOR IMAGE ON A THERMAL RECORDING MATERIAL

[75] Inventor: Kunio Hakkaku, Kanagawa, Japan

[73] Assignee: Fuji Photo Film Co., Ltd., Kanagawa, Japan

[21] Appl. No.: 549,992

[22] Filed: Jul. 9, 1990

[30] Foreign Application Priority Data

Jul. 11, 1989 [JP] Japan ..... 1-178235

[51] Int. Cl.[5] ..... B41M 5/34

[52] U.S. Cl. ..... 346/1.1; 250/316.1

[58] Field of Search ..... 346/1.1, 76 PH, 76 R; 400/120; 250/316.1, 317.1

[56] References Cited

U.S. PATENT DOCUMENTS 4,857,941 8/1989 Kaida ..... 346/76 PH
4,940,993 7/1990 Sato ..... 346/76 PH
4,962,386 10/1990 Hakkaku et al. ..... 346/76 PH

FOREIGN PATENT DOCUMENTS 2141279 5/1990 Japan .

*Primary Examiner*—Benjamin R. Fuller
*Assistant Examiner*—Huan H. Tran
*Attorney, Agent, or Firm*—Sughrue, Mion, Zinn, Macpeak & Seas

[57] ABSTRACT

An image recording method for recording an image on a thermal recording material by developing colors by heating one or more times the thermal recording material having thermal color developing transparent layers in the form of triple layers which respectively develop different hues, the thermal color developing transparent layers in the form of triple layers being formed on one side of a transparent carrier thereof. The image recording method comprising the following steps of: selecting pixels to develop their colors in at least the outermost layer in accordance with the hue to be recorded; causing the outermost layer and an inner layer positioned next to the outermost layer to develop their colors for each of the pixels; subjecting the outermost layer to a fixing process; selecting pixels to develop their colors in at least an intermediate layer which has not developed its color; causing the intermediate layer and the layer inner than the intermediate layer to simultaneously develop their colors; and successively subjecting the intermediate layer to a fixing processes to the innermost layer. Therefore, a color developing layer in the form of a multiplicity of layers formed on either side of the transparent carrier can be simultaneously subjected to the heat treatment and the color deviation can thereby be prevented. Therefore, the working efficiency can be improved and energy required to complete the recording operation can be reduced.

14 Claims, 9 Drawing Sheets

METHOD FOR RECORDING A MULTI-COLOR IMAGE ON A THERMAL RECORDING MATERIAL

BACKGROUND OF THE INVENTION

1. Field of the Invention

The present invention relates to an image recording method for recording an image on a thermal recording material having, on a transparent carrier thereof, a plurality of transparent thermal color developing layers which develop different hues.

2. Related Art Statement

There has been a thermal recording method for recording an image on recording paper by using a heater. According to a method described above, a thermal recording material, manufactured by applying a color former or a developer to a carrier such as paper or synthetic paper, is used so as to be heated by a thermal head of the thermal recording apparatus. The recent rapid developments in the information industry causes a desire to be able to easily obtain a color hard copy from a terminal equipment such as a computer and a facsimile. However, the structure must be arranged in such a manner that color developing mechanisms corresponding to the number of colors to be developed are mounted on one carrier and each of the color developing mechanism is operated under control for the purpose of forming a multi-color image on the thermal recording material. Therefore, a sufficient image in terms of the quality of the hues and color separation has not yet been obtained in spite of conventional great efforts.

Accordingly, the applicant of the present invention has disclosed a multi-color thermal recording material capable of forming an excellent thermal color image by providing thermally transparent type color developing layers on one side of a carrier, such color developing layers each developing a different hue.

According to the above-made disclosure, a multi-color image, exhibiting excellent hue, excellent color separation characteristics and image durability, can be obtained in comparison to the conventional methods. Furthermore, the obtained image can be made a transparent image or a reflected image.

Since thermal recording paper of the type described above has a color developing layer in the form of a multiplicity of layers, it must be subjected to a heating process in such a manner that the uppermost layer (the outermost layer) is heated so as to develop its color with a heating value which does not heat another layer and then another color developing layer is subjected to the heating process after the hue of the uppermost layer has been fixed.

However, in the above-described conventional method, there arises a problem in that color deviation cannot be prevented because the same image must be recorded by three process so as to develop its colors when an image is recorded on the multi-color thermal recording material. Therefore, it is necessary for the thermal recording material to be accurately positioned. As a result, the working efficiency has not been satisfactory.

SUMMARY OF THE INVENTION

Accordingly, an object of the present invention is to provide an image recording method capable of simultaneously subjecting a multi-layered color developing layers formed on either side of the transparent carrier to the heat treatment, causing the color deviation to thereby be prevented and the working efficiency to thereby be improved.

An aspect of the present invention lies in an image recording method for recording an image on a thermal recording material by developing colors by heating one or more times the thermal recording material having a plurality of thermal color developing transparent layers which respectively develop different colors, the thermal color developing transparent layers being formed on one side of a transparent carrier thereof, the image recording method comprising the following steps of: selecting pixels to develop their colors in at least the outermost layer in accordance with the hue to be recorded; causing the outermost layer and an inner layer positioned next to the outermost layer to develop their colors for each of the pixels; subjecting the outermost layer to a fixing process; selecting pixels to develop their colors in at least an intermediate layer which has not developed its color; causing the intermediate layer and the layer inner than the intermediate layer to simultaneously develop their colors; and successively subjecting the intermediate layer to a fixing process to the innermost layer, the outermost layer being the layer positioned nearest the heating phase and the same may be a layer positioned at the largest distance from the carrier or may be a layer positioned nearest the carrier.

According to the present invention, provided that the transparent thermal color developing layer is, as shown in FIGS. 1A to 1F, constituted by three layers: a cyane (to be abbreviated to "C" hereinafter) layer, a magenta (to be abbreviated to "M" hereinafter) layer and a yellow (to be abbreviated to "Y" hereinafter) layer when viewed from the outside, pixels including C-pigment are selected. Some of the thus selected pixels are formed by the C-pigment and other pixels are formed by a mixture of the M-pigment and the Y-pigment. Then, a procedure to develop cyane, blue, black, green, magenta, red and yellow for each pixel will be described with reference to FIGS. 1A to 1F.

When heat is applied to the pixels, the C-layer is, as designated by a hatching section shown in FIG. 1A, first developed by the energy of heat thus applied. The energy of heat applied this time can be controlled by, for example, adjusting the time in which heat is applied. Assuming that the C-layer develops its color as a result of heating for T msec, the M-layer develops its color as a result of the application of the heat for 2T msec and the Y-layer develops its color as a result of the application of the heat for 3T msec, the C-layer develops its color after a lapse of time of 1 msec. At this time, the application of heat to only the C-pigment is stopped. In addition, since the necessity of the color development of the M-pigment can be eliminated in the case where the pixels are formed by the C-pigment and the Y-pigment, also the heat application to the pixels of this type is stopped.

On the other hand, the pixels to which heat has been continuously applied causes the Y-layer to develop its color after a lapse of time of 3T msec as shown in FIG. 1E. As a result, color of the mixture of the M-pigment and the Y-pigment can be developed. Thus, a second scanning operation is completed, and the M-layer is fixed. Then, pixels, which have as yet not develop their colors and which include the Y-pigment, are selected so as to be subjected to the heating process. In this case, since both the C-layer and the M-layer have been fixed previously, the Y-layer is able to develop its color after a lapse of time of 3T msec without the change in the C-layer and the M-layer.

As described above, according to the present invention, a plurality of color developing layers are, as much as possible, arranged to simultaneously develop their colors for each of pixels. Therefore, the color deviation inevitably arising due to the individual scanning operation in terms of time can be prevented. Therefore, the quality of the formed image can be significantly improved. In addition, the positioning operation can be easily completed, causing the working efficiency to be improved.

Although the description is made with reference to the structure formed by three layers for the purpose of facilitating the description of the present invention, the present invention is not limited to the above-made description. The present invention can be applied to all of thermal recording paper sheets if they are formed by overlapping a plurality of layers.

According to the present invention, the structure may be arranged in such a manner that a plurality of color developing layers are caused to develop their colors by independently reading image signals denoting black color at the time of causing the outermost layer to develop its color. As a result, the number of data items can be reduced and high speed processing can thereby be realized in a case of, in particular, image recording operation including the processing of characters and the like.

Furthermore, a structure may be employed in which the output level of each of colors except for the black image signal is measured at the time of causing the outermost layer to develop its color. In this case, if the output level is lower than a predetermined value, it is determined that the subject image is a white and black image formed by only characters and the like. Therefore, only the outermost layer is subjected to the scanning process and the scanning of the layers inner than the outermost layer is stopped. Therefore, the unnecessary color developing can be restricted so that a clear image formed by characters and the like can be obtained.

Although the description is made about a structure in which the energy necessary to perform the heating process is controlled by the time in which heat is applied, it may be controlled by enlarging/reducing the heating value of the heater for each of the pixels.

Other and further objects, features and advantages of the invention will appear more fully from the following description.

DESCRIPTION OF THE PREFERRED EMBODIMENTS

Preferred embodiments of the present invention will now be described with reference to the drawings.

Figure 1A:
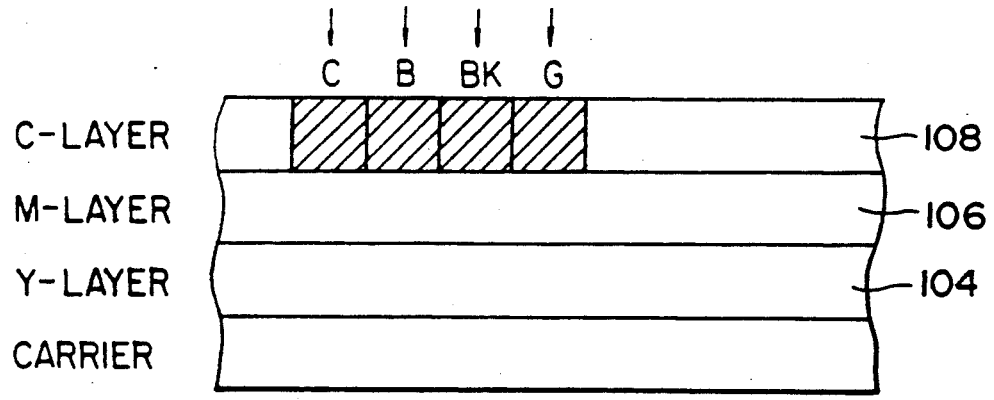
FIGS. 1A to 1F illustrate an image recording method according to the present invention.
Figure 1B:
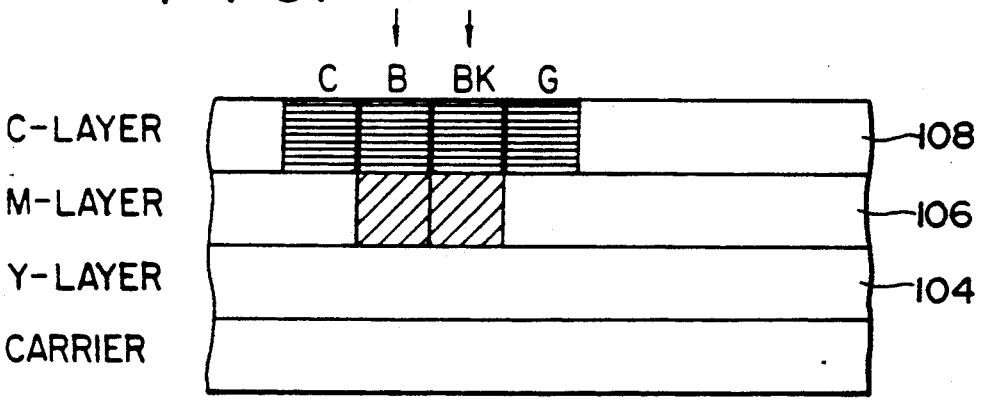
Figure 1C:
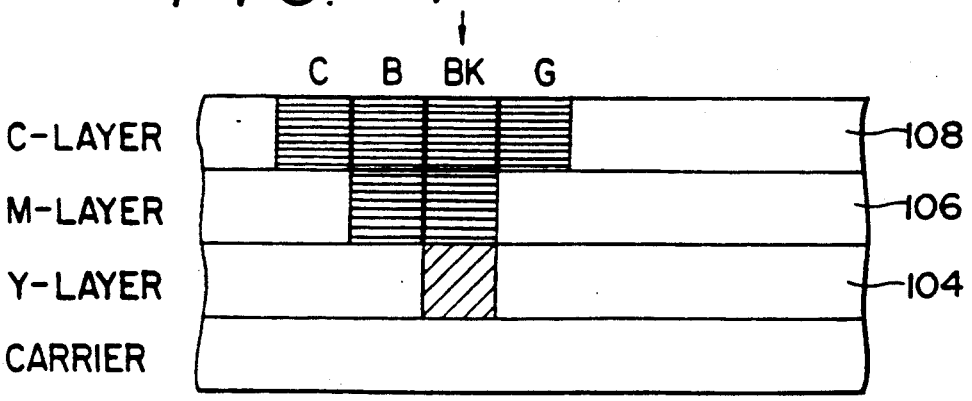
Figure 1D:
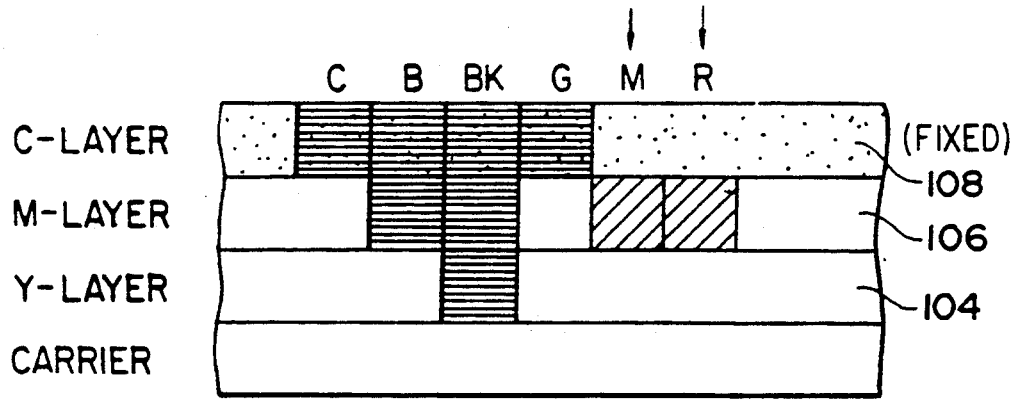
Figure 1E:
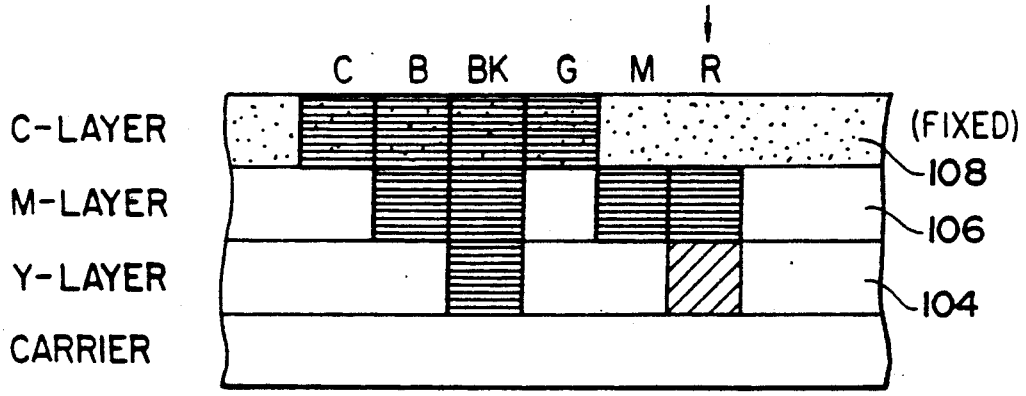
Figure 1F:
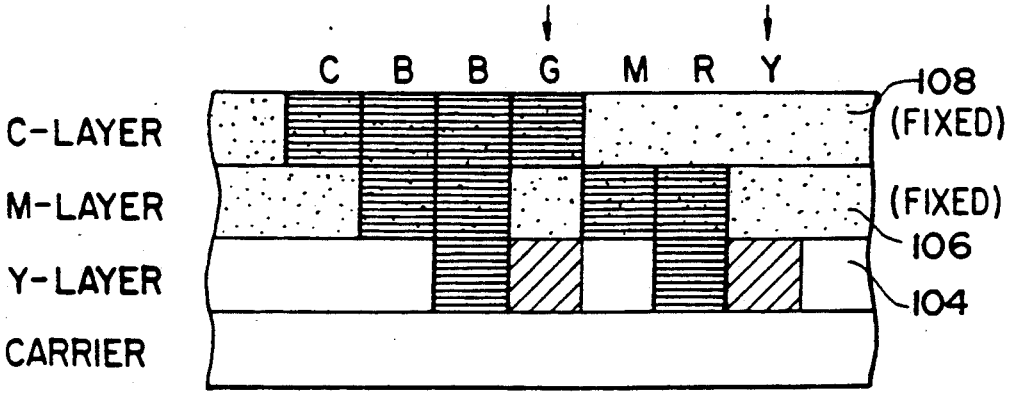
Figure 2:
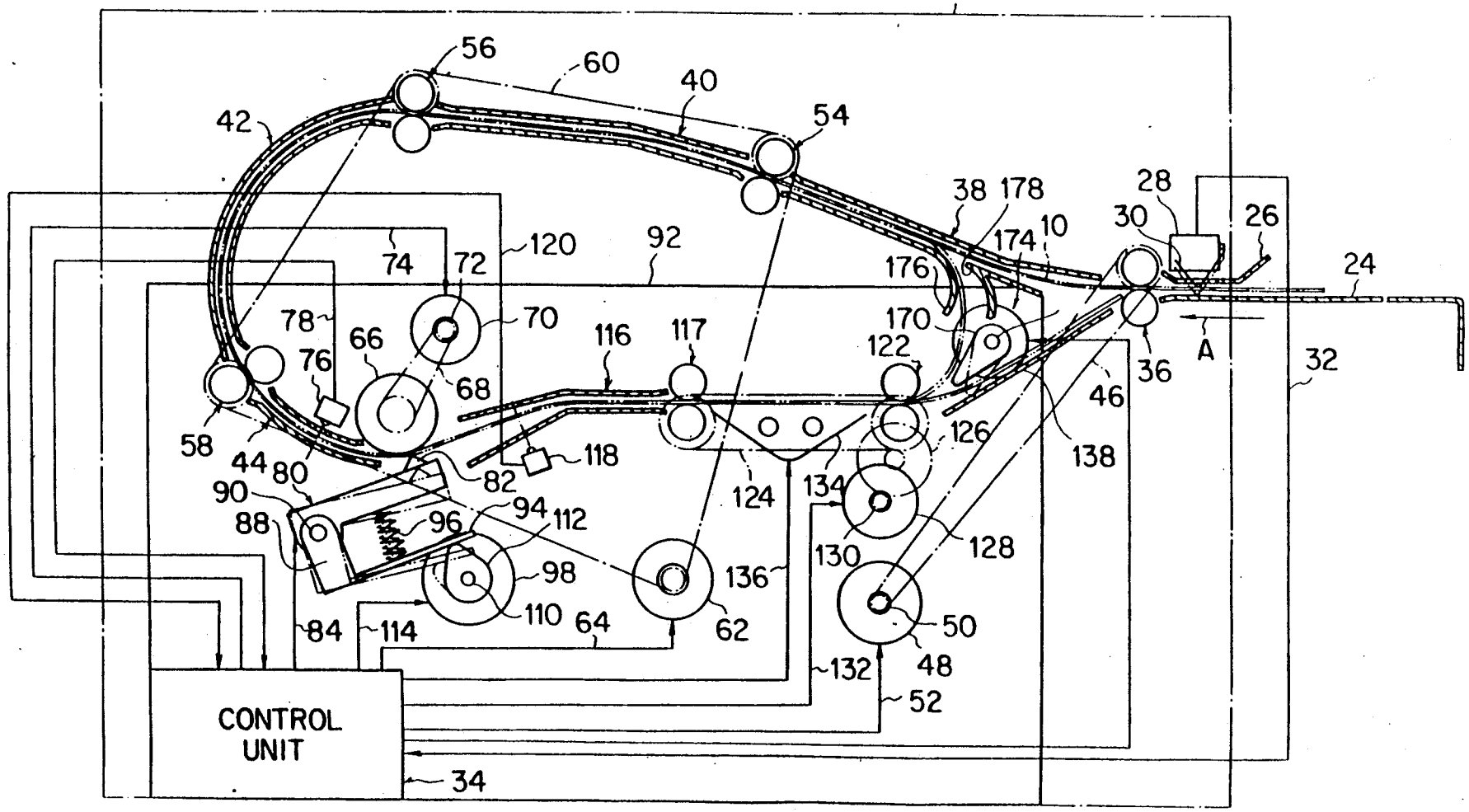
FIG. 2 is a schematic structural view which illustrates an image recording apparatus to which the present invention is applied.

FIG. 2 illustrates the schematic structure of an image recording apparatus to which the image recording method according to the present invention has been applied.

Referring to FIG. 2, a retaining table 24, for retaining a thermal recording material 10, is allowed to project over the right side surface of the casing 20. When the thermal recording material 10 is placed on the retaining table 24 in such a manner that the color developing layer of the thermal recording material 10 faces upwards and the front end portion of the same is forcibly moved into the casing 20, the thermal recording material 10 can be conveyed in a direction designated by an arrow A shown in FIG. 2.

The thermal recording material 10 is connected in such a manner that color developing layers (Y, M and C) 104, 106 and 108 are successively formed on one side of its carrier in a direction toward outside (see FIG. 1).

A micro-switch 28 is disposed in the lower stream from the retaining table 24 via a guide plate 25, the micro-switch 28 having a contact 30 which is arranged so as to be brought into contact with a conveyance passage through which the thermal recording material 10 passes. The contact 30 is in the form of a substantial V-shape so that it can switch the contact point formed in the micro-switch 28 when the thermal recording material 10 passes by the contact 30 (the micro-switch 28 is switched on when the thermal recording material 10 is detected, while the same is switched off when it is not detected). A signal line 32 of the micro-switch 28 is connected to a control unit 34.

The thermal recording material 10, which has passed through the micro-switch 28 in a direction from the right portion when viewed in FIG. 2, is then held by a pair of first conveyance rollers 36. As a result, the thermal recording material 10 is guided by guide plates 38, 40, 42 and 44 which are respectively provided so as to correspond to the two sides of the thermal recording material 10. Therefore, the thermal recording material 10 is conveyed in the form of a substantial C-shape by the guide plates 38, 40, 42 and 44.

The first conveyance roller 36 is connected to a rotational shaft 50 of a motor 48 via a drive belt 46. The motor 48 has its signal line 52 connected to the control unit 34 so that it can be rotated forwards and rearwards.

A pair of second conveyance rollers 54 is disposed between the guide plate 38 and the guide plate 40, while a pair of third conveyance rollers 56 is disposed between the guide plate 40 and the guide plate 42. Furthermore, a pair of fourth conveyance rollers 58 is disposed between the guide plate 42 and the guide plate 44. The above-described conveyance rollers 54, 56 and 58 are connected to the rotational shaft of a motor 62 by a drive belt 60. The motor 62 has its signal line 64 connected to the control unit 34 so that is can be rotated in a direction (the clockwise direction when viewed in FIG. 2) in response to a signal transmitted from the control unit 34.

A platen roller 66 is positioned in the vicinity of the guide plate 44 in such a manner that the platen roller 66 confronts the side of the front portion of the thermal recording material 10 in the conveyance direction on which no color developing layer is formed. The platen roller 66 is connected to a rotational shaft 72 of a motor 70 via a drive belt 68. The motor 70 has its signal line 74 connected to the control unit 34 so as to be rotated in a direction.

A first photoelectric sensor 76 is disposed between the platen roller 66 and the fourth conveyance roller 58. The first photoelectric sensor 76 is arranged to be a reflection type sensor having the contact which is switched depending upon the existence of the thermal recording material 10 (the photoelectric sensor 76 is turned on when the thermal recording material 10 is detected, while the same is turned off when it is not detected). The first photoelectric sensor 76 has its signal line 78 connected to the control unit 34.

Furthermore, a line thermal head 80 serving as a recording head is disposed so as to confront another side of the thermal recording material 10 at a position near he platen roller 66. A heater 82 is fastened to an end portion of the thermal head 80 so that the thermal recording material 10 is heated since the heater 82 generates heat in response to an image signal supplied from the control unit 34 via a signal line 84. The heating value of the heater 82 can be varied by the time in which the heater 82 generates heat. That is, according to this embodiment, a C-color layer 108 develops its color as a result of the application of heat for 1 msec, the C-color layer 108 and an M-color layer 106 develop their colors as a result of the application of heat for 2 msec, and the C-color layer 108, the M-color layer 106 and a Y-color layer 104 develop their colors as a result of the application of heat for 3 msec. Therefore, a plurality of colors can be developed in a single scanning operation (a heating processing) by controlling the above-described heating time.

Figure 3:
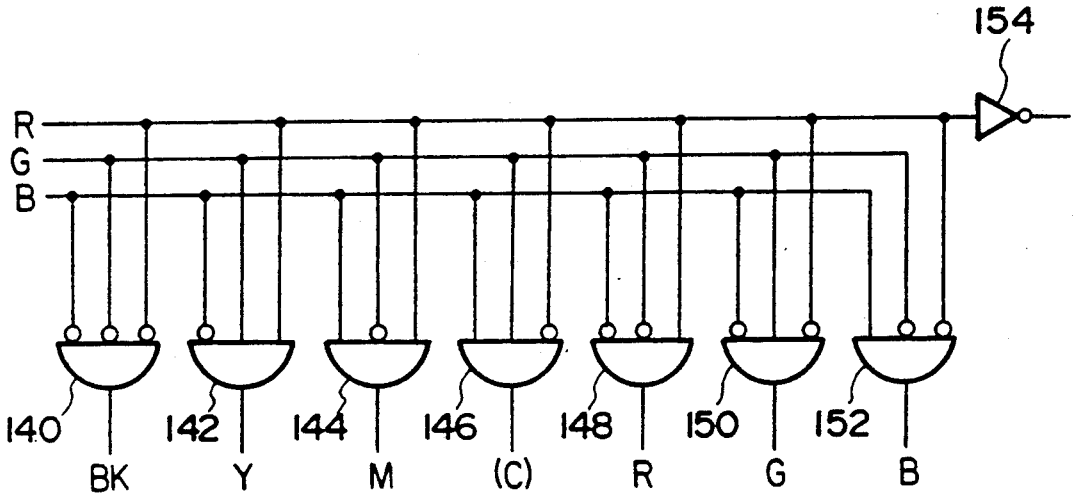
FIG. 3 illustrates a circuit from which an image signal is obtained.

FIG. 3 illustrates a schematic structure from which image signals denoting 8 colors can be obtained from R, G and B signals.

A first AND circuit 140 is supplied with an inverted signal of each of the R, G and B signals at the input side thereof so that color Bk (black) is obtained. A second AND circuit 142 is supplied with an inverted signal of the B signal and the R and G signals at the input side thereof so that color Y (yellow) is obtained. A third AND circuit 144 is supplied with an inverted signal of the G signal and the R and B signals at the input side thereof so that color M (magenta) is obtained. A fourth AND circuit 146 is supplied with an inverted signal of the R signal and the G and B signals at the input side thereof so that color C (cyane) is obtained. A fifth AND circuit 148 is supplied with an inverted signal of each of the G and B signals and the R signal at the input side thereof so that color R (red) is obtained. A sixth AND circuit 150 is supplied with an inverted signal of each of the R and B signals and the G signal at the input side thereof so that color G (green) is obtained. A seventh AND circuit 152 is supplied with an inverted signal of each of the R and G signals and the B signal at the input side thereof so that color B (blue) is obtained. A signal line through which the R signal passes is connected to an inverting circuit 154 so that an inverted signal of color R (red) is transmitted. Therefore, the output from the fourth AND circuit 146 becomes unnecessary to obtain color C (cyane).

Furthermore, color W (white) can be obtained by preventing the transmission of the signal.

Figure 4:
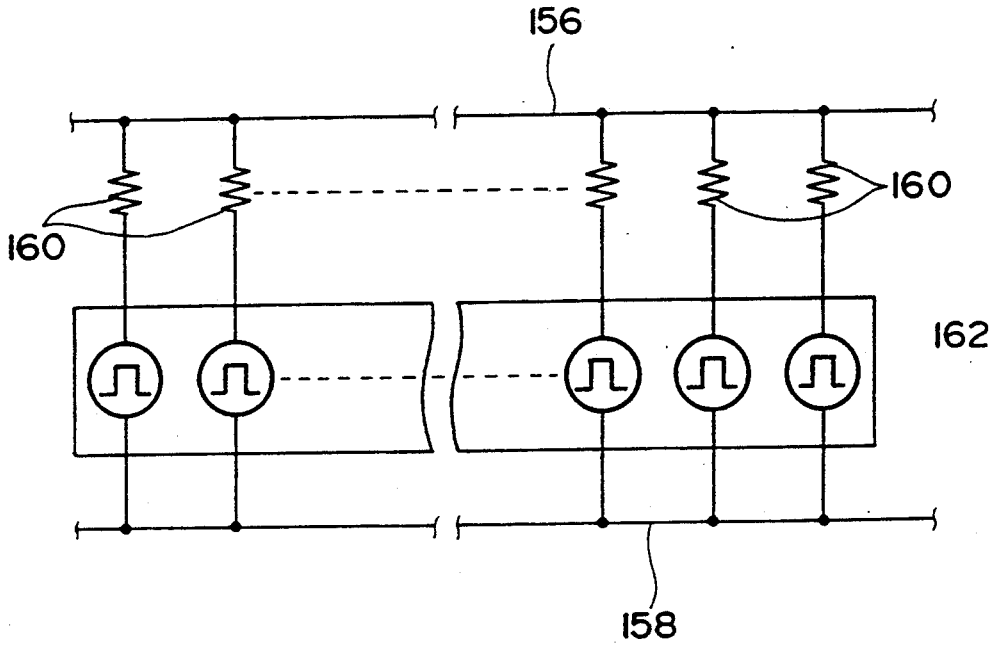
FIG. 4 is a schematic view which illustrates the internal portion of a thermal head.

In response to the output signals obtained from the above-described structure, the time, in which the heater 82 generates heat for each of pixels of the thermal head 80, is determined. That is, as shown in FIG. 4, resistors !60 and registers 162 constituting the heater 82 are, in series, connected between a positive side power source line 156 and a negative side power source line 158. The number of each of the resistors 160 and the registers 162 is arranged to be the same or more number of the pixels for one line. The registers 162 are arranged in such a manner that the pulse widths ($P_1$, $P_2$ and $P_3$), to be supplied to the resistors 160, are registered therein. When power is supplied to the positive side power source 156, an electric current is passed through the resistor 160 for a time which corresponds to the pulse width registered in the registers 162. As a result, heat can be generated. According to this embodiment, pulse width $P_1$ is arranged to be 1 msec, $P_2$ is arranged to be 2 msec and $P_3$ is arranged to be 3 msec. Since the thermal recording material 10 according to this embodiment is arranged to be in the form of a triple-layer structure, the scanning operation (the heating operation), corresponding to the pulse width which has been determined as described above, is performed three times.

The pulse width to be registered in the register 162 is arranged to be determined in accordance with an image signal output shown in FIG. 3. The following table shows the pulse widths corresponding to colors and the scanning timing.

| Picture Signal | Pulse Width | Scanning Timing |
|---|---|---|
| C | P1 (1 msec) | First scanning |
| Y | P3 (3 msec) | Third scanning |
| M | P2 (2 msec) | Second scanning |
| R | P3 (1 msec) | Second scanning |
| G | P1 (1 msec) | First scanning |
| | P3 (3 msec) | Third scanning |
| B | P2 (2 msec) | First scanning |
| Bk | P3 (3 msec) | First scanning |
| W | — | — |

Figure 5:
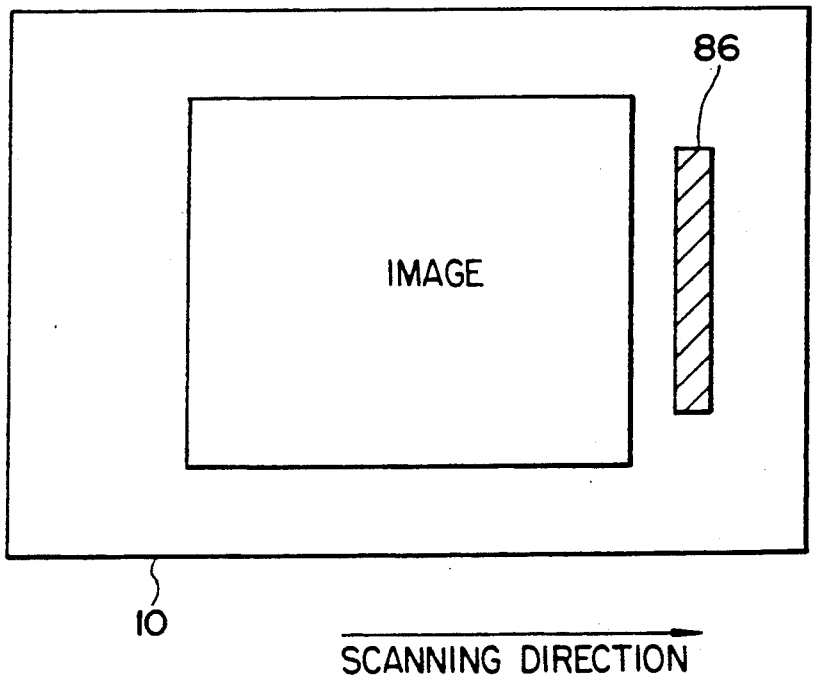
FIG. 5 is a front elevational view which illustrates a thermo-sensitive material.

A positioning signal is arranged to be transmitted from the control unit 34 to the thermal head 80. The positioning signal is transmitted at the time of thermal recording the first color layer (the C-color layer 108 according to this embodiment) so that a bar-like positioning line 86 as shown in FIG. 5 is recorded. The above-described positioning line 86 is arranged to be recorded after a lapse of certain time from the time at which the front portion of the thermal recording material has been detected by the first photoelectric sensor 76. The recording timing for each of the other colors is determined in accordance with the above-described positioning line 86.

The thermal head 80 is rotatably supported by an apparatus frame 92 via a shaft 90 in such a manner that the thermal head 80 can be rotated relative to the shaft 90 with respect to the position of the bracket 88 by a predetermined angular degree. The bracket 88 has an elongated member 94 elongated in parallel with the thermal head 80. A compression coil spring 96 is interposed between the elongated member 94 and the thermal head 80. The thermal head 80 is urged in a direction in which it is separated from the platen roller 66 relative to the shaft 90 by the urging force of the compression coil spring 96. A cam 112 fastened to a rotational shaft 110 of a motor 98 is disposed in the above-described direction in which the bracket 88 is urged by the compression coil spring 96, the cam 112 supporting the bracket 88. The motor 98 has its signal line 114 connected to the control unit 34 so that the motor 98 is rotated in the forward and rearward directions in response to a signal supplied from the control unit 34.

When the cam 112 is brought to a state designated by a continuous line shown in FIG. 2, also the bracket 88 and the thermal head 80 respectively become the states as designated by continuous lines shown in FIG. 2. As a result, the thermal recording material 10 can be held between the thermal head 80 and the platen roller 66. When the cam 112 has been brought to a state designated by a phantom line shown in FIG. 2, the thermal head 80 is separated from the platen roller 66 so that a gap is created therebetween.

Guide plates 116 for guiding the two sides of the thermal recording material 10 are disposed in the downstream from the platen roller 66. Therefore, the thermal recording material 10 is guided by the guide plates 116 so that it reaches a pair of fifth conveyance rollers 117. The thermal recording material 10 is thus held between the fifth conveyance rollers 117. A second photoelectric sensor 118 is disposed above the guide plate 116. The second photoelectric sensor 118 acts to detect the above-described positioning line 86, the second photoelectric sensor 118 being connected to the control unit 34 via a signal line 120.

The fifth conveyance rollers 117 are connected to a pair of sixth conveyance rollers 122 disposed in the downstream thereof via a drive belt 124. The pair of sixth conveyance rollers 122 are connected to a rotational shaft 130 of a motor 128 via a gear 126. The motor 128 has its signal line 132 connected to the control unit 34 so that it is rotated in a direction in response to a signal supplied from the control unit 34.

A pair of light sources 134 is disposed so as to confront the surface (color developing layer side) of the thermal recording material 10 at a position between the fifth conveyance rollers 117 and the sixth conveyance rollers 122. The pair of light sources 134 has its signal line 136 connected to the control unit 34 so that it is turned on/off in response to a signal supplied from the control unit 34.

The wavelength of light emitted from the light source 134 can be changed to about 360 nm and 400 nm so as to respectively fix the C-color layer 108 and the M-color layer 106 of the thermal recording material 10.

A guide plate 138 is disposed in the downstream from the pair of the sixth conveyance rollers 122, the guide plate 138 having the front portion extended to a position near the above-described first conveyance roller 36. When the first conveyance rollers 36 are rotated reversely, the thermal recording material 10, which has been guided and conveyed by the guide plate 138, is held so as to be placed on the retaining table 24.

A cam 170 for switching the conveyance passage is disposed at a position near the guide plate 138 in such a manner that the cam 170 confronts the reverse side of the thermal recording material 10. A shaft 172 serves as the center of rotation of the cam 170 so that when the shaft 172 is rotated in the forward or reverse direction by the rotational force of a motor 174, the thermal recording material 10 is guided to a position under the cam 170 when viewed in FIG. 2 (the cam 170 is positioned as designated by a continuous line shown in FIG. 2) or the same is guided above the cam 170 when viewed in FIG. 2 (the cam 170 is positioned as designated by a phantom line shown in FIG. 2.) Then, the position of the cam 170 designated by the continuous line shown in FIG. 2 is called "a discharge position" hereinafter, while the position of the same designated by the phantom line shown in FIG. 2 is called "a loop position" hereinafter.

The thermal recording material 10, which has been guided to the position above the cam 170 when viewed in FIG. 2, is guided by a guide plate 176 so as to pass through a hole formed in the above-described guide plate 38. Then the thermal recording material 10 is again held between the pair of the conveyance rollers 54 so as to be brought into a loop conveyance passage. That is, according to this embodiment, the same surface is scanned (heated) three times. Therefore, the cam 170 is positioned at the position designated by the phantom line shown in FIG. 2 so that the thermal recording material 10, which has been inserted from the retaining table 24, is guided to a loop conveyance passage. After the scanning has been then performed three times, the cam 170 is moved to the position designated by the continuous line shown in FIG. 2 before the thermal recording material is taken out to the retaining table 24.

Figure 6:
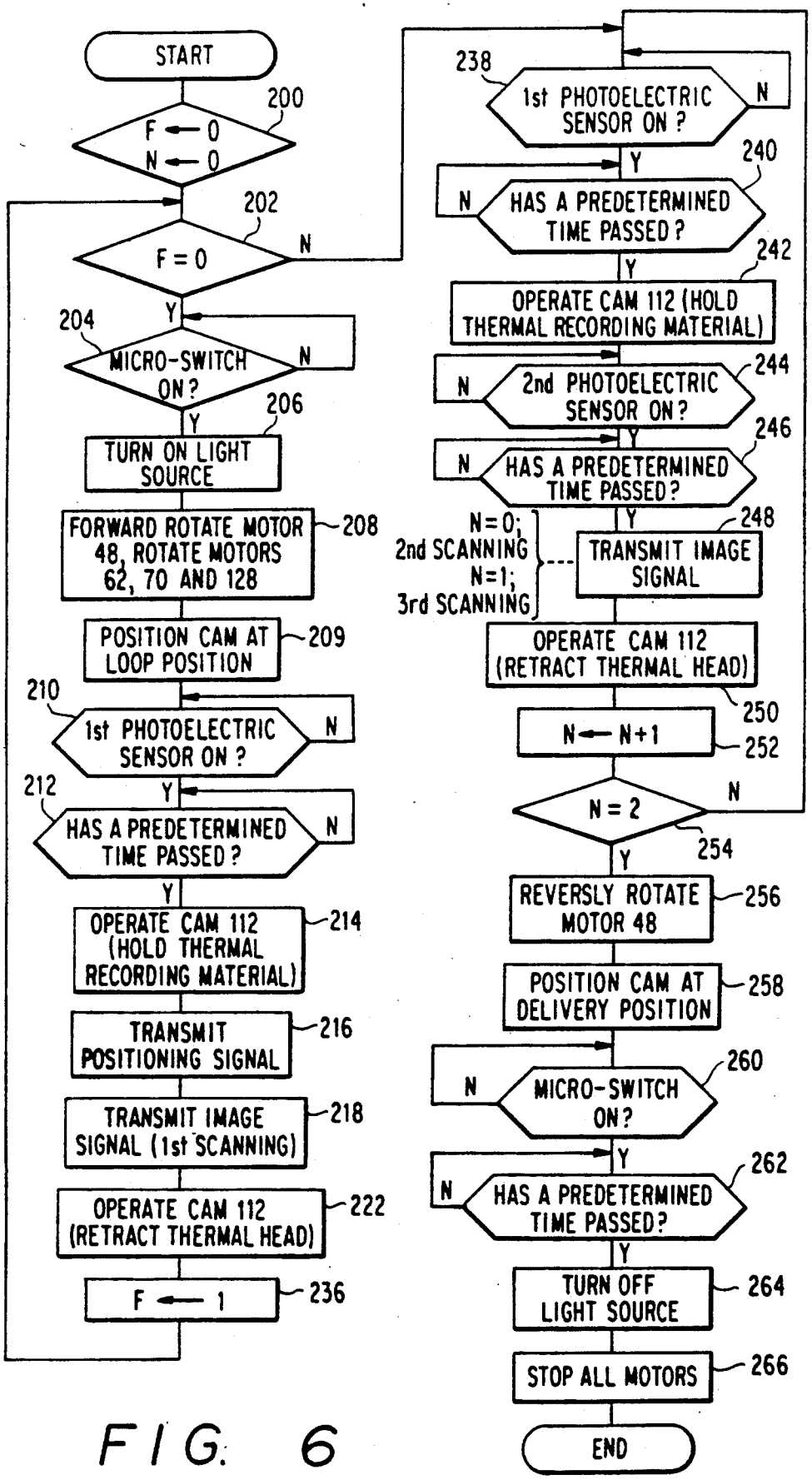
FIG. 6 is a control flow chart according to a first embodiment of the present invention.

Then, the operation of this embodiment will be described with reference to a control flow chart shown in FIG. 6.

In step 200, flag F is reset (to 0) so as to clear variable N before the flow advances to step 202 in which a fact whether or not flag F has been set is determined. Since flag F has been reset at the initial state according to this embodiment, a case, in which it has been determined that flag F has been set, will be first described.

If it has been determined, in step 202, that flag F has been set, the flow advances to step 204 in which it is determined whether or not the micro-switch 28 has been switched on. That is, when the thermal recording material 10 is placed on the retaining table 24 before the front portion of the thermal recording material 10 is forcibly introduced into the casing 20, the contact 30 moves as designated by the continuous line shown in FIG. 2 so that the micro-switch 28 is switched on. When the micro-switch 28 has been switched on, the flow advances to step 206 in which the light source 134 is turned on. Then, the motor 48 is rotated forwards in step 208 so that the motors 62, 70 and 128 are rotated. As a result, the cam 170 is positioned at the loop position (the position designated by the phantom line shown in FIG. 2) in step 209. Then, the flow advances to step 210 in which the thermal recording material 10 is introduced into the loop conveyance passage constituted by the guide plates 38, 40, 42 and 44. As a result, the thermal recording material 10 is conveyed to the platen roller 66. In this state, the thermal head 80 is positioned away from the platen roller 66 (see the phantom line shown in FIG. 2).

In step 210, it is determined whether or not the first photoelectric sensor 76 has been turned on. When the first photoelectric sensor 76 has been turned on, the front portion of the thermal recording material 10 can be detected. The thermal recording material 10 is able to reach the platen roller 66 after a lapse of certain time (step 212) from the above-described time in which the front portion of the thermal recording material 10 has been detected.

In next step 214, the motor 98 is rotated so that the cam 112 is rotated clockwise when viewed in FIG. 2. As a result of the above-described rotation of the cam 112, the elongated member 94 is pushed upwards so that the bracket 88 is rotated relative to the shaft 90. Thus, the thermal recording material 10 can be held between the heater 82 of the thermal head 80 and the platen roller 66. Since the thermal head 80 has been urged by the compression coil spring 96, the thermal recording material 10 can be held under a substantially constant pressure level.

In next step 216, the above-described positioning signal is transmitted prior to the transmission of the image signal so that the positioning line 86 is written. Then, the flow advances to step 218 in which the first scanning operation is performed. Since the way to perform the first scanning operation has been described in the chapter abut the operation of the invention, its description is omitted here.

After a predetermined writing operation has been completed in steps 216 and 218, the flow advances to step 222 in which the motor 98 is rotated so that the cam 112 is rotated counterclockwise when viewed in FIG. 2. As a result, the thermal head 80 is retracted so that the thermal recording material 10 is released from the state in which it is held between the thermal head 80 and the platen roller 66.

The thermal recording material 10 is then guided by the guide plate 116 so as to be held and conveyed by the fifth and the sixth pairs of conveyance rollers 117 and 122.

In a space between the fifth pair of the conveyance rollers 117 and the sixth pair of the conveyance rollers 122, the C-color layer 108 is subjected to a fixing process by light emitted from the light source 134. The thermal recording material 10, which has been subjected to the fixing treatment, is then guided by the guide plate 176 so as to reach the guide plate 176 disposed above the cam 170 when viewed in FIG. 2. As a result, the thermal recording material 10 passes through the hole 178 formed in the guide plate 38 before it is conveyed in a direction toward the conveyance roller 54.

During this, flag F is set to "1" in step 236 before the flow advances to step 202.

If it has been determined in step 202 that flag F has not been set, that is, after the image recording of the C-color layer 108 has been completed, the flow advances to step 238 in which the front portion of the thermal recording material 10 is detected by the first photoelectric sensor 76. After a lapse of predetermined time (step 240), the flow advances to step 242. In step 242, the cam 112 is operated so that the thermal recording material 10 is held between the thermal head 80 and the platen roller 66. Then, in step 244, it is determined whether or not the positioning line 86 has been detected, the above-described determination being made in accordance with the fact that the second photoelectric sensor 118 has been turned on or off.

If it has been determined in step 244 that the positioning line 86 has been detected, the flow advances to step 246 in which the lapse of the predetermined time is waited for. Then, the flow advances to step 248 in which the image signal is transmitted so that the second and the third scanning operations are performed. The fact that variable N is "0" means the second scanning, while the fact that the same is "1" means the third scanning. Since the second and the third scanning operations have been described in the chapter about the operation of the present invention, their descriptions are omitted here.

In step 250, the cam 112 is operated so as to retract the thermal head 80. Then, the flow advances to step 252 in which variable N is added by one.

In next step 254, it is determined whether or not variable N is "2". If it has been determined that variable N is not "2", it is determined that the second scanning has been completed. Then, the flow advances to step 238 in which the third scanning is performed. If it has been determined that variable N is "2", it is determined that the third scanning has been completed. Then, the flow advances to step 256 in which the motor 48 is rotated reversely. Then, in step 258, the cam 170 is positioned to the delivery position. As a result, the thermal recording material 10 is moved to the position below the cam 170 when viewed in FIG. 2. Then, the thermal recording material 10 is guided by the guide plate 138 so as to be held between the first conveyance rollers 36. In this state, since the first conveyance rollers 36 have been rotated reversely, the thermal recording material 10 is conveyed to the retaining table 24.

Then, in step 260, it is determined whether or not the micro-switch 28 has been switched on. It is determined that the thermal recording material 10 has been delivered to the retaining table 24 if the predetermined time has passed (step 262) from the time at which the micro-switch 28 had been switched on. Then, the flow advance to step 264 in which the light source 134 is turned off. In step 266, the motors 48, 62, 70 and 128 are then stopped so that the image recording operation is completed.

As described above, according to the first embodiment of the present invention, different colors can be simultaneously developed. Therefore, any color deviation of, in particular, colors blue, red and black can be prevented. As a result, clear image can be formed.

In the conventional sublimation type thermal transcribing method in which image recording is performed by using Y, M and C ink films, a black image is formed by three times of scanning operations. According to this method, it can be formed only by a single operation. Therefore, energy required to complete the recording can be reduced.

Second Embodiment

According to the first embodiment, images are recorded by using digital signals. However, images can as well be recorded by using analog signals such as NTSC video signals.

Figure 7:
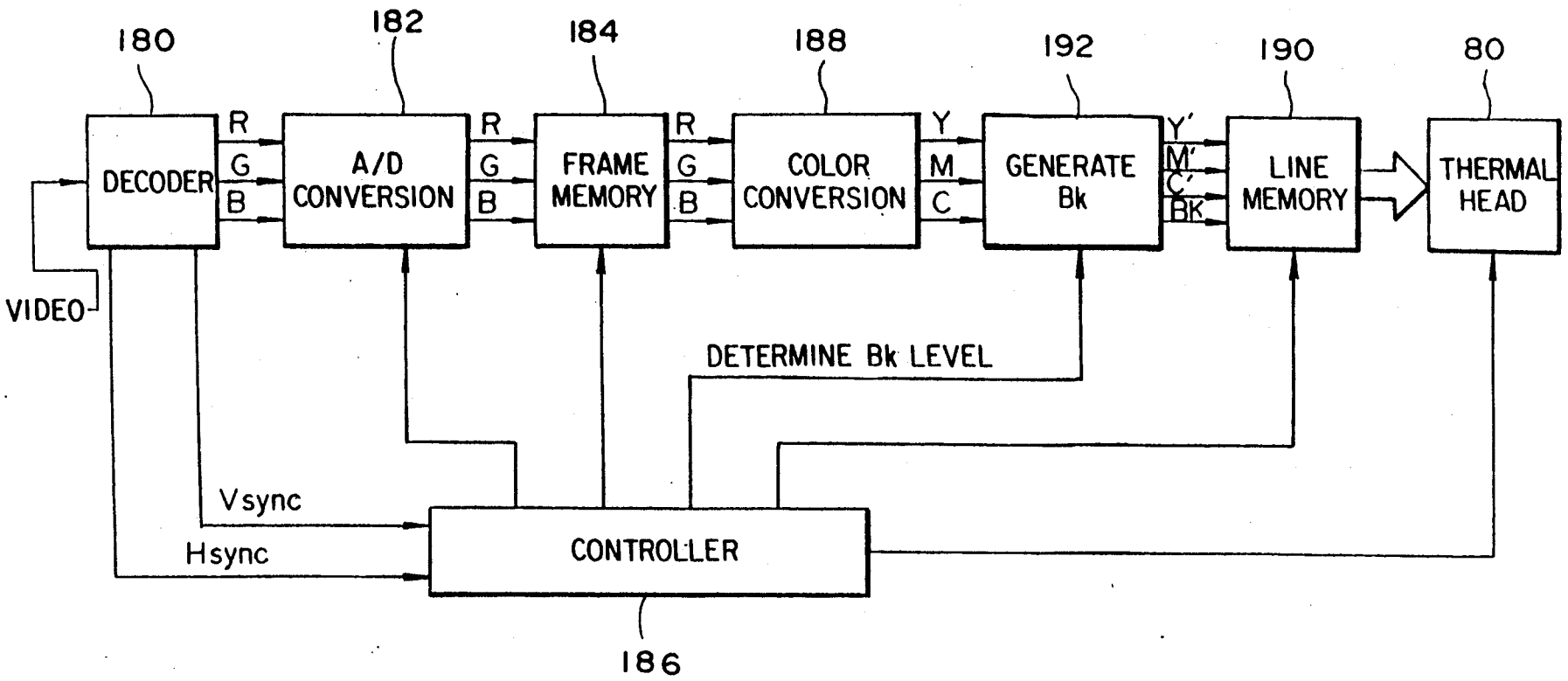
FIG. 7 is a block diagram with which image recording on the basis of an analog signal according to a second embodiment can be performed.

Then, the structure for recording an image by using an analog signal will be described with reference to FIG. 7.

A video signal is supplied to a decoder 180 in which it is then divided into colors R, G and B before being supplied to an A/D converter 182. The A/D converter 182 converts the supplied R, G and B signals into digital signals so as to transmit them to a frame memory 184. The frame memory 184 stores image signals for an image. The decoder 180 is connected to a controller 186 to which a horizontal synchronizing signal and a vertical synchronizing signal are supplied. The thus supplied horizontal synchronizing signal and a vertical synchronizing signal are transmitted to the A/D converter and the frame memory 184 so as to establish a synchronized state.

The R, G and B signals stored in the frame memory 184 are converted into Y, M and C signals by a color converter 188 before they are transmitted to a line memory for every line. A black signal generator 192 is disposed between the color converter 188 and the line memory 190 so as to generate a black signal independently from Y', M' and C'signals. Therefore, a signal for obtaining black color is omitted from the Y, M and C signals transmitted from the black signal generator 192.

A vertical synchronizing signal is supplied to the line memory 190 from the controller 186. In response to the thus supplied vertical synchronizing signal, a signal is transmitted to the thermal head 80 so that an image is recorded.

As a result, recording of Bk at a pulse width of 3 msec and recording of C' at a pulse width of 0 to 1 msec are performed in the first scanning operation. Recording of M' at a pulse width of 1 to 2 msec is performed in the second scanning operation. Furthermore, recording of Y' at a pulse width of 2 to 3 msec is performed in the third scanning operation. Therefore, an image in which black characters and full color images are mixed with one another without color deviation can be obtained.

Third Embodiment

Figure 8:
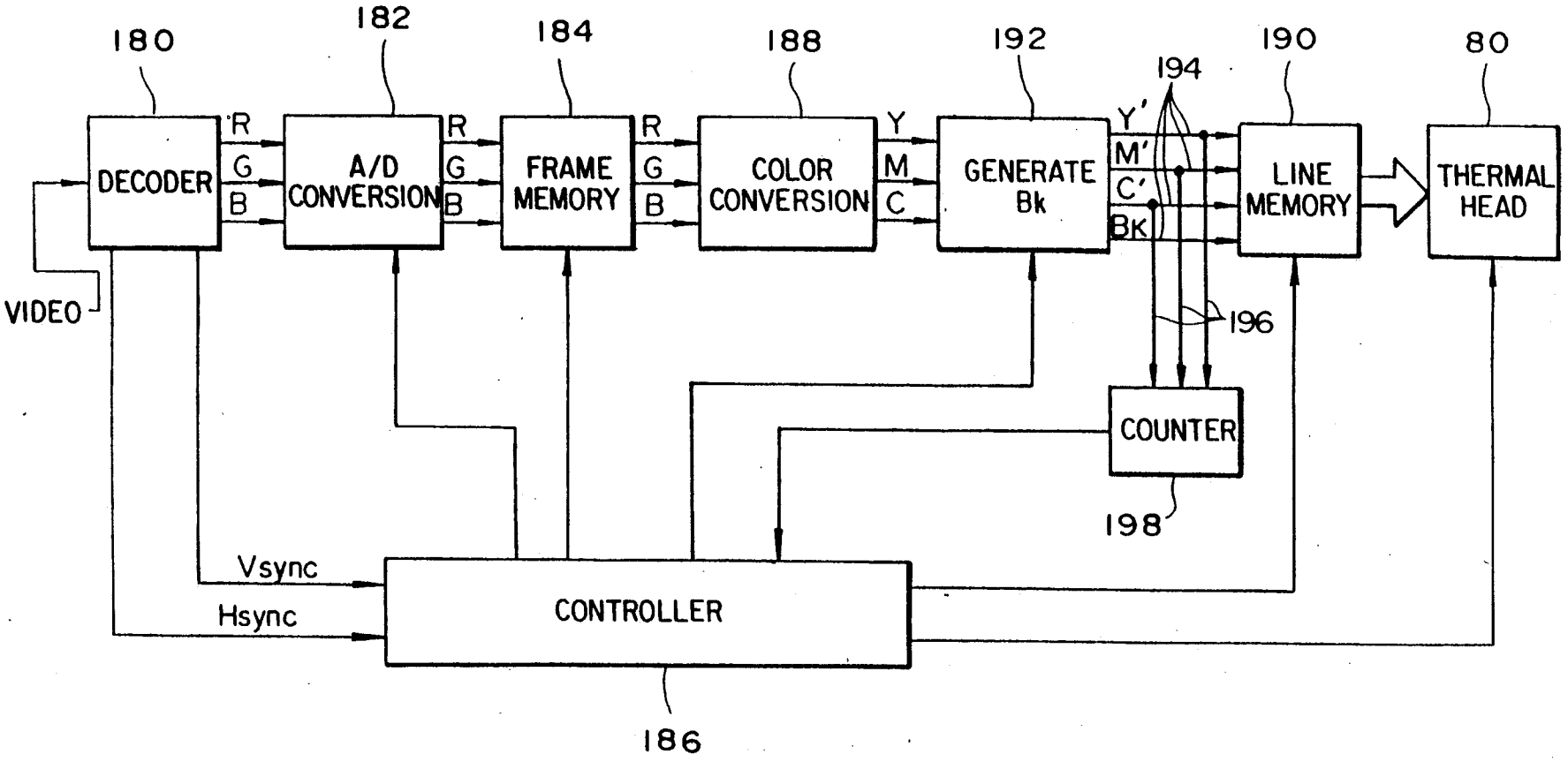
FIG. 8 is a block diagram with which the recording of a white and black image according to a third embodiment of the present invention can be performed.

A third embodiment of the present invention will be described with reference to FIG. 8. The same elements as those according to the second embodiment are given the same reference numerals and the descriptions about them are therefore omitted. The third embodiment is characterized in its structure enabling a monochrome mode to be automatically selected in consideration of the fact that the recording of characters are mainly performed by forming white and black images.

An end portion of a branch line 196 is connected to each of signal lines 194 respectively transmitting Y', M'and C' signals from the black signal generator 192 to the line memory 190. Another end portion of the branch line 196 is connected to a counter 198. The counter 198 is arranged to counts the Y', M' and C' signals whenever they are transmitted from the black signal generator 192, the counter 198 being connected to the controller 186. The counter 198 is arranged to transmit a stop signal to the controller 186. When the controller 186 receives the stop signal, the ensuing image recording control is stopped.

If the Y', M' and C' signals exist at the time of the first scanning operation for an image, the counter 198 counts these signals Y', M'and C'. If there is no signals, no counting is performed. Furthermore, if the counter 198 has not counted up to a predetermined number, it is determined that the subject recording operation is an operation to form a white and black image such as characters. As a result, the stop signal is transmitted from the counter 198 to the controller 186. In response to the thus supplied stop signal, the ensuing image recording control operation performed by the controller 186 is stopped. Therefore, the second and the third scanning operations are cancelled so that the time taken to complete the recording operation is reduced to one-third. Therefore, the time can be shortened in the case where the monochrome image such as characters is recorded.

As described above, an excellent effect can be obtained from the image recording method according to the present invention in that a multi-layered color developing layer formed on either side of the transparent carrier can be simultaneously subjected to the heat treatment and the color deviation can thereby be prevented. Therefore, the working efficiency can be improved and energy required to complete the recording operation can be reduced.

Although the invention has been described in its preferred form with a certain degree of particularly, it is understood that the present disclosure of the preferred form has been changed in the details of construction and the combination and arrangement of parts may be resorted to without departing from the spirit and the scope of the invention as hereinafter claimed.

What is claimed is:

1. An image recording method for recording an image on a thermal recording material in plural colors, by heating said thermal recording material at least once, said thermal recording material comprising on one side of a carrier thereof, a plurality of thermal color developing transparent layers which respectively develop different hues, said plurality of layers comprising at least an outermost layer, an intermediate layer and an innermost layer, a first heating and color developing process, comprising:

(a) selecting pixels in said outermost layer of and simultaneously selecting positionally corresponding pixels in at least said intermediate layer, which are to be simultaneously developed in said respectively different hues, in accordance with the hue to be recorded; and (b) heating at least a portion of said recording material so as to develop said selected pixels'colors in accordance with the hue to be recorded.

2. An image recording method according to claim 1 further comprising:

(c) subjecting said outermost layer to a fixing process;

(d) selecting pixels which have not been developed in said intermediate layer and simultaneously selecting positionally corresponding pixels in at least said inner layer which are to be simultaneously developed in said respectively different hues, in accordance with the hue to be recorded in a second thermal color developing process;

(e) heating at least a portion of said recording material corresponding to said pixels selected in step (d) so as to develop said selected pixels'colors in accordance with the hue to be recorded;

(f) subjecting said intermediate layer to a fixing process;

(g) selecting pixels which have not been developed in said innermost layer for developing said selected pixels' color in said innermost layer in accordance with the hue to be recorded in a third heating and color developing process; and (h) heating a portion of said recording material corresponding to said pixels selected in step (g) so as to develop said selected pixels'color.

3. An image recording method according to claim 1, wherein said process for developing color in said at least one outermost layer is performed by controlling the time in which heat is applied.

4. An image recording method according to claim 3, wherein said time in which heat is applied is determined in accordance with the hue recorded by said selected pixels.

5. An image recording method according to claim 1, wherein said selection of said pixels in step (a) is performed by an image signal.

6. An image recording method according to claim 5, wherein a plurality of color developing layers are caused to develop their colors by reading a black image signal at the time of heating said outermost layer so as to develop its color.

7. An image recording method for recording an image on a thermal recording material in plural colors, by heating said thermal recording material at least once, said thermal recording material comprising on one side of a transparent carrier thereof, thermal color developing transparent layers in the form of three layers which respectively develop different hues, said three layers comprising an outermost layer, intermediate layer and innermost layer, said method comprising the steps of:

(a) selecting pixels in said outermost layer and simultaneously selecting positionally corresponding pixels in at least said intermediate layer, which are to be simultaneously developed in said respectively different hues, in accordance with the hue to be recorded;

(b) heating at least a portion of said recording material so as to develop said selected pixels' colors in accordance with the hue to be recorded;

(c) subjecting said outermost layer to a fixing process;

(d) selecting pixels which have not been developed in said intermediate layer and simultaneously selecting positionally corresponding pixels in at least said inner layer which are to be simultaneously developed in said respectively different hues, in accordance with a hue to be recorded;

(e) heating at least a portion of said recording material corresponding to said pixels selected in step (d) so as to develop said selected pixels' colors in accordance with the hue to be recorded;

(f) subjecting said intermediate layer to a fixing process;

(g) selecting pixels which have not been developed in said innermost layer for developing said selected pixels'color in said innermost layer in accordance with the hue to be recorded; and (h) heating a portion of said recording material corresponding to pixels selected in step (g) so as to develop said selected pixels'color in accordance with the hue to be recorded.

8. An image recording method according to claim 7, wherein said color development in each of steps (b), step (e) and step (h) is performed by controlling the time in which heat is applied.

9. An image recording method according to claim 8, wherein said time in which heat is applied is determined in accordance with the hue recorded by said selected pixels.

10. An image recording method according to claim 7, wherein said selection of said pixels in step (a) is performed by an image signal.

11. An image recording method according to claim 10, wherein a plurality of color developing layers are caused to develop their colors by reading a black image signal at the time of heating said outermost layer so as to develop its color.

12. An image recording method according to claim 7, wherein a color development position determining mark for said thermal recording material is recorded on said thermal recording material prior to said heating and color development process in step (b), and said heating and color development is performed in at said heating and color development in step (e) and step (h) in accordance with said mark which has been recorded.

13. An image recording method according to claim 10, wherein the level of the output of each of color except for a black image signal is measured at the time of color developing in said outermost layer so that when said level is lower than a predetermined value, heating of a color development layer inner than said outermost layer is stopped.

14. An image recording method according to claim 7, wherein said color development process in each of step (b), step (e) and step (h) is performed by controlling the heating value of each of said pixels in said heating process.

* * * * *